US010022787B2

(12) United States Patent
Haun et al.

(10) Patent No.: US 10,022,787 B2
(45) Date of Patent: Jul. 17, 2018

(54) METHOD AND SYSTEM FOR SENSING INGOT POSITION IN REDUCED CROSS-SECTIONAL AREA MOLDS

(71) Applicant: RETECH SYSTEMS LLC, Ukiah, CA (US)

(72) Inventors: Robert E. Haun, Healdsburg, CA (US); Paul G. Meese, Healdsburg, CA (US)

(73) Assignee: Retech Systems, LLC, Ukiah, CA (US)

( * ) Notice: Subject to any disclaimer, the term of this patent is extended or adjusted under 35 U.S.C. 154(b) by 214 days.

(21) Appl. No.: 14/834,189

(22) Filed: Aug. 24, 2015

(65) Prior Publication Data

US 2017/0056968 A1 Mar. 2, 2017

(51) Int. Cl.

| | |
|---|---|
| ***B22D 11/20*** | (2006.01) |
| ***B22D 11/041*** | (2006.01) |
| ***B22D 11/14*** | (2006.01) |
| ***B22D 11/18*** | (2006.01) |
| ***B22D 7/00*** | (2006.01) |
| ***B22D 9/00*** | (2006.01) |

(52) U.S. Cl.

CPC ..... *B22D 11/20* (2013.01); *B22D 7/005* (2013.01); *B22D 9/003* (2013.01); *B22D 11/041* (2013.01); *B22D 11/141* (2013.01); *B22D 11/18* (2013.01)

(58) Field of Classification Search

CPC ..... B22D 11/141; B22D 11/18; B22D 11/041; B22D 11/20; B22D 11/201–11/206; B22D 7/005; B22D 9/003

See application file for complete search history.

(56) References Cited

U.S. PATENT DOCUMENTS

| | | | | |
|---|---|---|---|---|
| 4,572,812 | A * | 2/1986 | Ciszek | B22D 27/02 164/467 |
| 5,042,559 | A * | 8/1991 | Krause | B22D 11/145 164/150.1 |
| 6,006,821 | A | 12/1999 | Haun et al. | |
| 8,689,856 | B1 | 4/2014 | Jacques et al. | |
| 2005/0175063 | A1 | 8/2005 | Roberts et al. | |
| 2008/0035298 | A1 | 2/2008 | Yu et al. | |
| 2010/0282427 | A1 | 11/2010 | Jacques et al. | |
| 2014/0182416 | A1 | 7/2014 | Lampson et al. | |
| 2014/0326427 | A1 | 11/2014 | Jacques et al. | |

FOREIGN PATENT DOCUMENTS

WO 2014047220 A1 3/2014

OTHER PUBLICATIONS

Extended European Search Report received in European Application No. EP 16183163; 7 pages.

* cited by examiner

*Primary Examiner* — Kevin P Kerns
*Assistant Examiner* — Steven S Ha
(74) *Attorney, Agent, or Firm* — Kilpatrick Townsend & Stockton LLP

(57) ABSTRACT

A system and method for sensing the position of an ingot within a segmented mold of a vacuum metallurgical system. An inductive sensory system measures the variations in current between a power source and load of an induction heating coil. The system and method is particularly suitable for determining the position of an ingot within a melting system mold where the mold has a relatively reduced or small cross-sectional area.

18 Claims, 5 Drawing Sheets

C
C
A
A

B
B

SECTION B-B

SECTION A-A

SECTION C-C

METHOD AND SYSTEM FOR SENSING INGOT POSITION IN REDUCED CROSS-SECTIONAL AREA MOLDS

CROSS-REFERENCE TO RELATED APPLICATIONS

N/A

BACKGROUND OF THE INVENTION

In industry, vacuum metallurgical melting systems have been built and operated to produce high quality ingots of reactive or refractory metals and/or their alloys in a single operational process directly from raw materials. In some such systems, raw materials can be provided into an open-top and open-bottom mold, having an heating induction coil surrounding at least part of the mold. The raw materials (or feed material) can be metals such as titanium, zirconium, nickel, cobalt, and/or their alloys, and can be provided into a mold of a vacuum metallurgical system in solid or molten form. When rendered into molten form, these metals can be contaminated by the oxide refractories generally used to make induction melting crucibles; therefore, to avoid contamination, these metals are typically melted in water-cooled copper vessels, although this melting technique is only about 25% efficient thermally.

Relatively small cross-sectional, ingots, bars, and castings of reactive or refractory metals/alloys made with vacuum metallurgical melting systems are used throughout the aerospace, automotive, energy, and medical industries. They can be machined or forged into any number of shapes. They may be used as the feedstock to be drawn into wire or to be rendered into a powdered metal. Such small cross-sectional bars are typically made from larger ingots which are incrementally heated to high temperatures and then forged down into the desired size. The forging process can lead to considerable yield loss however—a 60-70% yield of usable metal is typical. This is due in part to deformation of the ends of the ingot after a number of forging steps. In addition, it can take months for an ingot to await its turn in queue to be forged. Still further, due to the relatively small surface-area-to-volume ratio of the large ingots and associated cooling rates, the grain size of the finished product may be larger or less homogeneous than desired or needed.

Parts made from powdered metals are increasingly common and desired. Powdered metals are usually formed by grinding, or by remelting and atomizing, an ingot or casting that has been cast from a molten material. The parts can then be produced by consolidating the powder either directly into a final shape, or into a preform that is then machined. In most uses, it is usually important that each powder particle be of the same composition. This can only be achieved by ensuring that the metal ingot or casting from which the powder is formed is homogeneous, which can in turn only be achieved if the molten metal from which the ingot or casting is made is homogeneous.

The most common method of ensuring homogeneity in the molten metal (and/or alloy) is to stir the molten metal prior to pouring the motel metal in a mold and/or during the period of time the molten metal is in a mold being cast as an ingot. Another method uses an induction coil, which is discussed in U.S. Pat. No. 6,006,821 to Haun et al., assigned to the Applicant and dated Dec. 28, 1999, which is hereby incorporated by reference. Alternative implementations of heating using a single power source with heating elements wirelessly connected in series are also discussed in U.S. patent application Ser. No. 14/031,008 to Lampson et al., assigned to the Applicant and filed on Sep. 18, 2013, which is hereby incorporated by reference.

Additional complications can arise from attempting to cast relatively larger ingots made of intermetallics such as titanium, zirconium, nickel, cobalt, aluminum and/or other metals in that such ingots can be prone to minor, major, and/or catastrophic mechanical failure. In some cases, as an ingot cools after being cast and withdrawn from a furnace, a temperature gradient can develop between the exterior/surface of the ingot and the interior/core of the ingot. With some metals and alloys, the rate of cooling and temperature gradient may be sufficiently divergent or extreme such that the ingot cracks, breaks, or shears away from itself, rendering the ingot unfit and unsafe for industrial use, or post-processing to render into a relatively smaller ingot.

For all these reasons, it is desirable to cast the ingots nearer to their desired final cross-sectional size, a feat which has heretofore not been accomplished for small cross-sectional ingots. It is further desirable to ensure that the ingots are as homogeneous as possible, for reasons apparent to those of ordinary skill in the art.

BRIEF SUMMARY OF THE INVENTION

This presently-disclosed invention describes a method and system for determining the position of an ingot within a segmented, water-cooled mold surrounded by an induction melting coil. In particular, a mold and coil assembly as disclosed herein is used to produce ingots having a relatively small or reduced cross-sectional dimension. Such ingots can be made of complex reactive or refractory metal alloys such as titanium aluminides or shape-memory nickel-titanium. Induction heating of the mold and its contents can ensure that high quality ingots (ingots that are generally free of internal voids and require minimal post-formation surface clean-up) can be produced. In part, production of high quality ingots is aided by ensuring that the top of the ingot is consistently located within an optimum zone of the mold for melting. In such systems employing a small or reduced cross-sectional area, however, there can be limited view angles within a vacuum metallurgical chamber, rendering visual monitoring and subsequent control of the ingot position within the mold problematic. The present disclosure provides for structure and means to sense the ingot position within the mold by monitoring the current amplitude or current frequency in the induction melting coil (that is connected to an induction power supply) and in the tuning capacitor(s). The induction melting coil current is calibrated for optimum melting conditions. As additional material is added to the top of the mold, the ingot is moved to maintain the induction melting coil current within an acceptable range.

In some embodiments, the present disclosure is directed to a vacuum metallurgical melting system having: a segmented mold having an input end and an extraction end, configured to receive and cast a molten metal or alloy into an ingot; a primary heating induction coil positioned at least in part around the segmented mold and configured to induce heat in an interior region of the segmented mold; an heating power supply electrically coupled to and powering the primary heating induction coil; a tuning capacitor configured to tune the electrical circuit comprising at least the primary heating induction coil, the segmented mold, and the power supply; at least one sense coil positioned at least in part around an electrical coupling or conductor between the tuning capacitor and the primary heating induction coil; an ingot position actuator positioned to support and move the ingot and/or molten metal or alloy within the segmented mold; and an ingot position controller operatively coupled to at least both the at least one sense coil and the ingot position actuator, and configured to instruct the ingot position actuator to move molten metal or alloy within the segmented mold.

In some aspects, the vacuum metallurgical melting system can further include a material feed configured to provide metal and/or alloy, in either or both of solid or molten form, to the input end of the segmented mold. The melting system can have a material feed that further includes: a crucible positioned proximate to the input end of the segmented mold and configured to provide a molten metal or alloy into the segmented mold; a crucible heating system configured to melt metal or alloy within the crucible; and a secondary power supply electrically coupled to and powering the crucible heating system. In such aspects, the crucible heating system further can include any one of a movable plasma arc torch, an electron beam gun, a secondary heating induction coil, or a combination thereof. The segmented mold of the melting system can be vertically oriented, and can further have segmentations running along the primary axis of the segmented mold. The at least one sense coil can be configured to convert either or both of current amplitude and current frequency detected in the electrical coupling or conductor between the heating power supply and the at least one primary heating induction coil into an electrical control signal that is provided to the ingot position controller. Further, the sense coil electrical control signal can be used by the ingot position controller to automatically manipulate the ingot position actuator, in order to move the ingot within the segmented mold such that the top of the ingot is positioned proximate to the primary heating induction coil, allowing the top of the ingot to be melted or remain molten. Alternatively, the sense coil electrical control signal can be read and used via operator interaction to manipulate the ingot position actuator to move the ingot within the segmented mold such that the top of the ingot is positioned proximate to the primary heating induction coil so to as to be molten. In some aspects, the segmented mold can have a cross-sectional area of about 7.1 square inches or less. In other aspects, the segmented mold can have a width or a diameter of about 3 inches or less.

In another embodiment, the present disclosure is directed to a method for determining the position of an ingot within a vacuum metallurgical system mold. The method can include the steps of: providing a metal and/or alloy into a segmented mold, where the segmented mold being an open-top and open-bottom mold; heating the metal and/or alloy within the segmented mold to its melting point with an heating induction coil; maintaining the molten metal and/or alloy in a molten state and melting any solid portion of the metal and/or alloy within the segmented mold to a molten state; forming an ingot within the segmented mold with the molten metal and/or alloy; and determining the position of the ingot within the segmented mold with a sense coil.

The heating induction coil and a high frequency power supply are electrically connected to a capacitor which is operable to tune the electrical circuit comprised of the induction coil, the mold and its contents, the capacitor, and the power supply to an optimum power level for melting within the mold. Further, the sense coil can be configured to detect electrical current in a conductor between the heating induction coil and the capacitor, such that the electrical current flowing through the induction melting coil and the capacitor induces a proportional current or frequency in the sense coil circuit. In other aspects, the sense coil can be connected in series with an electronic position controller that is configured to measure changes in electrical current detected by the sense coil. The method can further include: the electronic position controller converting the current detected in the sense coil into an electrical control signal; instructing an ingot position actuator to move the ingot within the segmented mold proximate to the heating induction coil; and maintaining the top of the ingot in a molten state. In some aspects, the electronic position controller can instruct the ingot position actuator via operator interaction. In other aspects, the electronic position controller can instruct the ingot position actuator via an automatic feedback loop. The method can further include melting metal and/or alloy in a primary melting vessel that is configured to pour a portion of molten metal and/or alloy into the top of the segmented mold. In other aspects, the method can include using a primary feeder, configured to deliver feed material in solid form into the top of the segmented mold. In other aspects, the electronic control signal can be used to adjust the power supplied to the heating induction coil and thereby adjust the degree of heating of an ingot within the mold. Further, the pour rate of molten metal and/or alloy into the segmented mold can be adjusted according to the determined position of the ingot within the segmented mold. Finally, the method can further include withdrawing the ingot from the segmented mold, where the ingot formed can have a reduced cross-sectional area.

BRIEF DESCRIPTION OF THE DRAWINGS

Illustrative aspects of the present disclosure are described in detail below with reference to the following drawing figures.

DETAILED DESCRIPTION OF THE INVENTION

Figure 1A:
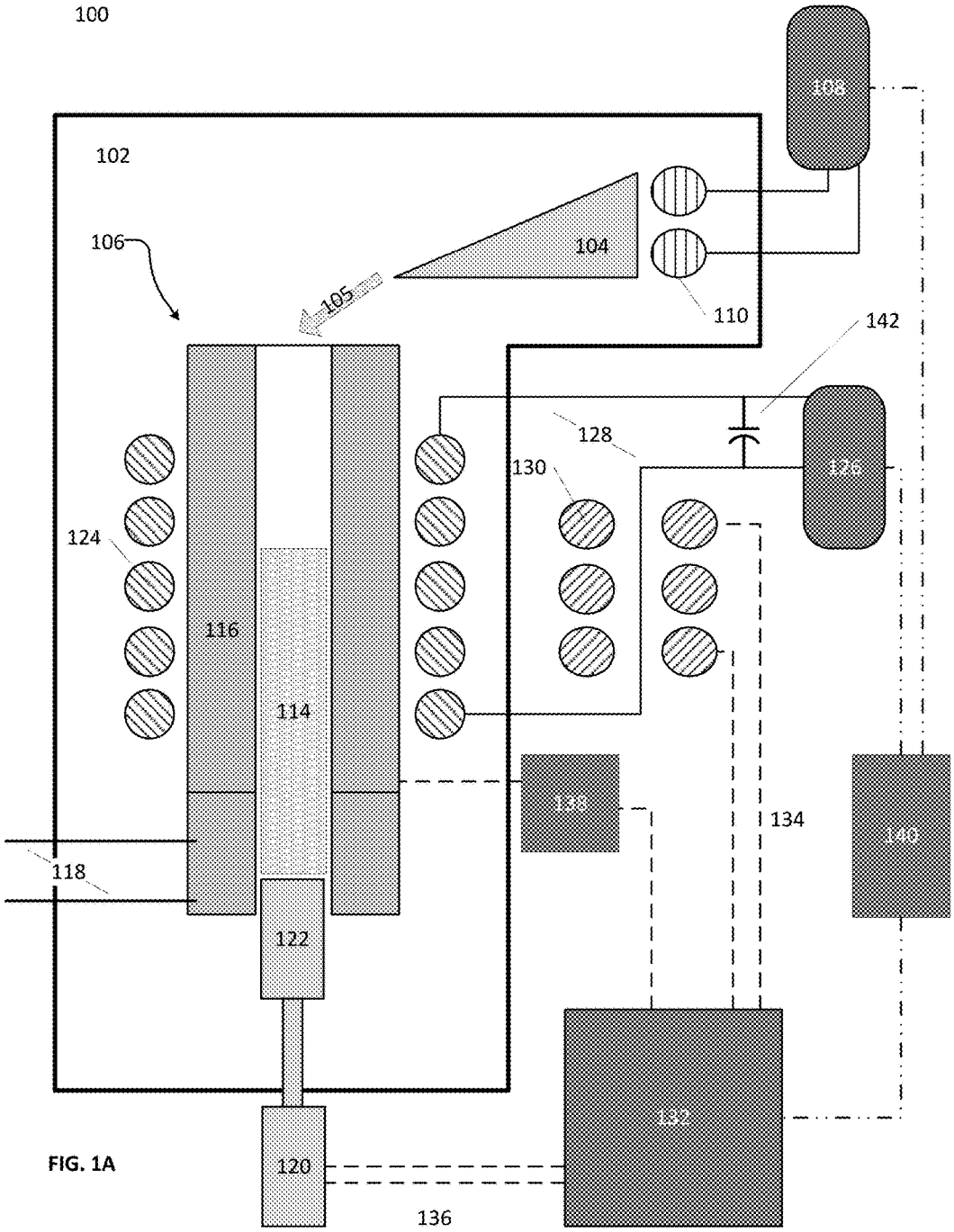
FIG. 1A is a schematic representation of a first embodiment of a vacuum metallurgical system for forming ingots, according to aspects of the present disclosure.

Throughout this description for the purposes of explanation, numerous specific details are set forth in order to provide a thorough understanding of the many embodiments disclosed herein. It will be apparent, however, to one skilled in the art that the many embodiments may be practiced without some of these specific details. In other instances, known structures and devices are shown in diagram or schematic form to avoid obscuring the underlying principles of the described embodiments.

The present disclosure relates to a system and method of determining the position of an ingot within a mold of a melting system, particularly a vacuum metallurgical melting furnace system, where the ingot cannot be readily observed due to the construction, configuration, and/or other design requirements of the mold as a part of the system. Exemplary embodiments provide a system and method, particularly including an inductive sensory system, for determining the position of an ingot within a segmented mold (alternatively referred to as a tundish). Knowing the position of an ingot within a mold allows for accurate manipulation of the ingot within the mold, such as adjusting or changing the position of the ingot within the mold, or altering the heating characteristics of a heating device in the melting system that is directed towards the mold. The present disclosure is considered especially useful for forming ingots having a reduced cross-section, relative to standard-sized ingots or castings traditionally known in the field. The present disclosure is also considered useful for forming ingots and/or castings that can be later be converted into powder, where homogeneity of each granule of powder is of interest. The present disclosure is further considered useful for forming ingots and/or castings for strand production, or strip castings. In many aspects, the present disclosure is considered particularly suitable for forming ingots composed of titanium, zirconium, nickel, cobalt, aluminum, and combinations and alloys thereof The terms "reduced cross-section", "small cross-section", and "standard-sized" are used throughout the present disclosure to describe categories of ingot as based on their cross-sectional size relative to each other and as used in the industry. As used herein, the terms "reduced cross-section" and/or "small cross-section" refer to ingots or castings having a width or diameter of about three inches (3 in.) or less, and/or ingots or castings having a cross-sectional area of typically 7.1 square inches or less (≤7.1 sq.in.). For example, a reduced cross-sectional mold could produce circular cross-sectional ingots with diameters of about three inches (≤3.0 in.) or less. Additionally or alternatively, the terms "reduced cross-section" and "small cross-section" can refer to a mold of any appropriate size to accomplish any one or more of the following effects: avoiding cracking in the final ingot; avoiding cracking of the ingot when it is processed during further fabrication into a finished product; allowing controlled cooling while the ingot solidifies; producing an ingot with any desired grain size, such as a comparatively small grain size (e.g. 100 micrometers or less).

Further, as used herein, the term "standard-sized" refers to ingots or castings having a width or diameter of about three to six inches (3-6 in.) or greater, and/or ingots or castings having a cross-sectional area of typically greater than 7.1 square inches (>7.1 sq.in.). Additionally, as used herein, the tem "metal/alloy" is used to refer to "metal, intermetallic, and/or alloy" and variations thereof in an abbreviated form.

In particular, aspects of the present disclosure provide a system and method for producing an ingot having a reduced cross-section. Raw materials of metals and/or alloys are fed into a segmented mold. The raw material of metal/alloy can be fed in solid form, or in molten form being melted in a vessel such as a crucible. An induction coil, provided around or below the vessel, provides for electromagnetic heating and/or stirring of the molten metal/alloy within the segmented mold. If the metal/alloy is fed into the segmented mold in solid form (via, e.g. a primary feeder such as a bar feeder), the induction coil can melt the raw material into molten form. The stirring of molten metal/alloy and consistent heating of specific regions of the molten metal/alloy as an ingot is formed can lead to superior homogeneity of the molten metal/alloy, as compared to other known systems.

In some implementations of vacuum metallurgical melting systems having an open-top and open-bottom segmented mold, an ingot cast within the mold is pulled out of the bottom of the mold while the top of the ingot is maintained molten by a heating induction coil arranged in part around the segmented mold. In some aspects, the open-top of a mold can be referred to as an input end, and the open-bottom of a mold can be referred to as an extraction end. By keeping the top of the ingot within the segmented mold molten, additional molten metal/alloy added to the ingot is more likely to form a strong homogeneous bond, and therefore become a part of the ingot with a minimum of mechanical flaws or other undesirable defects. Hence, heating the top of the ingot, wherever the ingot is positioned within the segmented mold, is advantageous to producing high quality ingots in a single or continuous operation.

A melting vessel (alternatively referred to as a crucible) can be used to melt down feed material metal/alloy into a molten metal/alloy before the feed material is fed to the segmented mold. The feed material enters the melting vessel, with the melting vessel in a feed and/or melt position, by an appropriate means such as being pushed in by bar feeder or dropped in by a bulk feeder. In some embodiments, a plasma arc torch melts the feed material in the melting vessel maintaining an un-melted skull on the bottom with a molten pool on the top. The molten contents of the melting vessel can be transferred to the mold by moving the melting vessel to a delivery position and tilt pouring the molten contents (alternatively referred to as "the melt") through a pour notch. Once the molten contents of the melting vessel have been transferred, the melting vessel can be returned to the feed and/or melt position and more solid material is directed into the melting vessel for subsequent melting.

In another embodiment, an electron beam gun can be used to melt metal and/or alloy in a water-cooled copper melting vessel. The water-cooled copper melting vessel can in turn tilt pour molten metal/alloy into the mold. In a further embodiment, the melting vessel can be an induction melting crucible, where the melting vessel is coupled to an induction heating coil (separate and distinct from the induction heating coil coupled to the segmented mold) to melt metal and/or alloy. The induction melting crucible can tilt and pour molten metal/alloy into the mold. In the above embodiments, each of the plasma arc torch, electron beam gun, and induction heating coil for the melting vessel/crucible can be powered by a power source dedicated to melting feed material. In embodiments where the feed material is a molten material, the molten material is directed into the small cross-sectional sized mold with minimal spillage, for example, through a pour notch on one end of the melting vessel. For molds of reduced cross-section, if a directed heat source, such as plasma arc torch, were used to heat the material in the top portion of the mold, the diameter of the plasma arc would be large enough to risk destroying the mold itself.

In alternative embodiments, the feed material provided to a segmented mold can be metal/alloy in solid form, which is melted within the segmented mold. In some aspects, metal/alloy can be melted within the segmented mold by a directed heating apparatus, such as a plasma arc torch or electron beam gun, positioned above the open-top of the segmented mold. In other aspects, metal/alloy can be melted within the segmented mold by the heating induction coil positioned and arranged in part around the segmented mold.

The segmented mold is typically made of copper and can be internally water-cooled, having channels running through at least a portion of the interior of the mold to allow for fluid to pass through and provide a heat exchange conduit. In some embodiments, the segmented mold has a small cross-sectional area—which in several implementations can be less than 7.1 square inches. The aspect ratio of the mold (i.e. the inside length divided by inside diameter) can range from about 2:1 to about 10:1. In some exemplary embodiments, the segmented, water-cooled mold can have an internal diameter of about fifty-three millimeters (53 mm). In other embodiments, the segmented, water-cooled mold can have an internal diameter of from about fifty millimeters to about one hundred two millimeters (~50 mm-102 mm), at any increment, gradient within that range.

Electrical power can be delivered to the induction coil surrounding a portion of the segmented mold by a high frequency induction power supply. A tuning capacitor can be used to tune the load (where the load is generally considered to include, but is not limited to, the segmented mold, the ingot contained therein, and the coil) to the power supply for optimum power input and melting performance. In some aspects, the tuning capacitor can be varied by adding capacitors. Tuning the load to avoid impedance mismatch with the power supply can optimize heat input with a minimum amount of input power.

During the casting process, the ingot is pulled out the bottom of the mold while the top of the ingot proximate to the induction coil is maintained as molten. Due to the relatively small inside diameter of the segmented mold discussed herein, and limited view angles from the vacuum metallurgical chamber walls (or lid), it can be difficult in practice for an observer or operator to accurately determine the ingot position within the mold by visual means. However, at a fixed power input to the induction coil, the ingot position can be sensed electrically by monitoring the circulating electrical current between the induction coil and the tuning capacitor using a sense coil (alternatively referred to as a sensor induction coil). Due to the high frequency current oscillating between the induction coil and the tuning capacitor, an electrically isolated sense coil can be used to measure that current. The sense coil is placed around one of the leads to the induction coil surrounding the segmented mold. The sense coil can be mounted external to the vacuum metallurgical chamber walls, but in between the tuning capacitor and the induction coil. The sense coil in turn is electrically connected to a current meter that is rated for the high frequency electrical current delivered by the induction power supply. This can be referred to as an inductive sensory system.

As the top of the ingot position changes within the mold, either by physically moving the ingot down with an appropriate manipulator or by adding molten material to the top of the mold from the melting vessel, the induction coil current changes. Provided the induction power supply is operated in a constant power output mode, the coil current fluctuates in a predictable manner from the tuned and calibrated value needed for optimum melting conditions. In the case of the mold (or relevant section of the mold) being completely full, the induction coil current reaches a low value. In the case of the mold (or relevant section of the mold) being nearly empty, the induction coil current reaches a high value. Thus, based on the current measurement (which can be a measurement of the either the current amplitude of the current frequency, or both) and understanding of how much of an ingot has been poured into and/or withdrawn from a mold, the position of the ingot within the mold can be determined. Depending on the stage of the ingot casting process, the ingot can further be moved within the mold to a desired location for particular processing operations. Similarly, the pour rate of feed material into the mold can be adjusted based upon the determined position of the ingot within the mold.

Figure 1B:
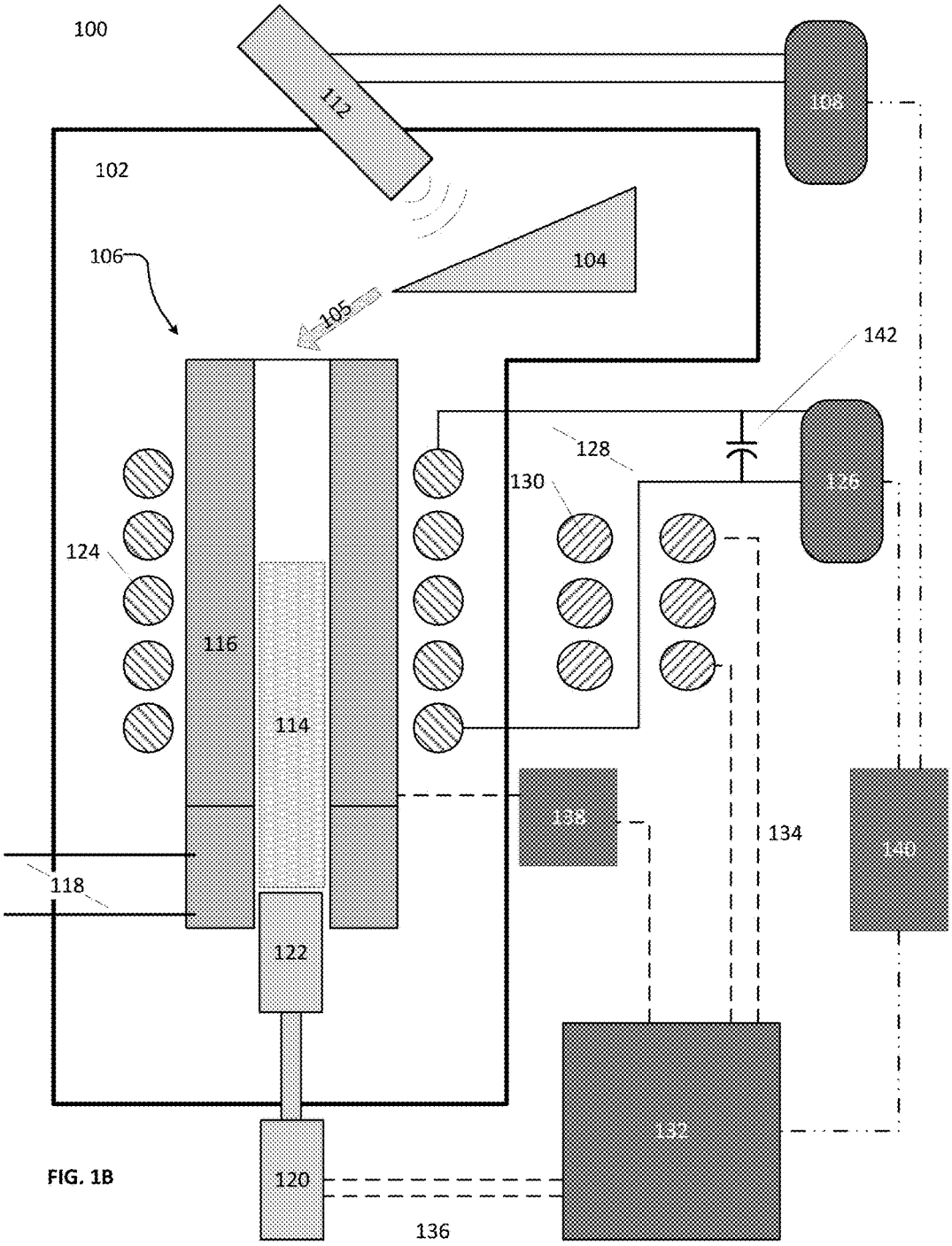
FIG. 1B is a schematic representation of a second embodiment of a vacuum metallurgical system for forming ingots, according to aspects of the present disclosure.

In both of FIG. 1A and FIG. 1B, the overall system 100 is based in vacuum metallurgical chamber 102. Within vacuum metallurgical chamber 102 is a material feed 104 and a water cooled mold 106. The material feed 104 can be part of a system where the material (metal/alloy) in the material feed 104 is melted before being provided to the segmented mold 106. In various aspects, the material feed 104 can be disposed completely within the vacuum metallurgical chamber 102, outside of the vacuum metallurgical chamber 102, or as a port in the wall of the vacuum metallurgical chamber 102. In some aspects, the segmented mold 106 can be a water-cooled mold. In many embodiments, the segmented mold 106 is an open-bottom mold, vertically oriented within the vacuum metallurgical chamber 102. The heating of the material feed can have a feed heating power supply 108. The feed heating power supply 108 can power various kinds of heating devices. In a first embodiment as shown in FIG. 1A, the feed heating power supply 108 can power a secondary heating induction coil 110, which can heat the metal/alloy feed through induction. In a second embodiment as shown in FIG. 1B, the feed heating power supply 108 can power a directed heating device 112, which in various embodiments can be a movable plasma arc torch or electron beam gun. Either of the secondary heating induction coil 110 or directed heating device 112 can be used individually or in combination for any given system 100. In some embodiments, the metal/alloy is provided from the material feed 104 in molten form, as a melt 105, to the segmented mold 106. In other embodiments, the metal/alloy is provided from the material feed 104 in raw (solid) form to the segmented mold 106. In further embodiments, the melt 105 may be further treated in intermediate vessels, such as additional dedicated melting hearths, or in one or more refining hearths (not shown).

In those instances in which an alloy ingot or other casting is desired, correct melting and mixing of the raw metal/alloy material is crucial. Achieving the desired mixture may be facilitated where the volume of the material feed 104 is large enough to hold the discrete pieces of raw material while melting, and is also large enough to effectively pre-mix the metal/alloy and even out any small compositional variations inherent to the raw material from one piece to the next. The desired mixture may be further achieved by purposely emptying the material feed 104 on a regular basis, leaving a minimal amount of skull to avoid the build-up of higher melting point elements, components, or alloys Once the material from the material feed 104 is provided to the segmented mold 106, the molten material can be kept molten or the solid material (or any remnant of solid material) from the material feed 104 can be melted down to a molten state, forming an ingot 114. The ingot forms within the mold walls 116, which are water cooled. A water source 118, having an inlet and outlet, is provided and connected to the segmented mold 106, running through the at least a portion of the interior of the mold walls 116.

An ingot position actuator 120 can move the ingot 114 within the water cooled mold 106. In some aspects the ingot position actuator 120 has a withdrawal head 122 configured to receive the ingot 114 when the metal/alloy first enters the segmented mold 106, whether metal/alloy is received from the material feed 104 as solid or molten. In various embodiments, the withdrawal head 122 can be a dovetail head, a threaded head, a tapered head, or a threaded tapered head. The ingot position actuator 120 can mechanically move an ingot 114 up or down within the segmented mold 106, and can retract such that the ingot 114 is withdrawn from the segmented mold 106 and the vacuum metallurgical chamber 102 entirely.

The segmented mold 106 can have a variety of cross-sectional shapes, specifically, the segmented mold 106 can have a circular, polygonal, or polygonal with rounded corners cross-section. Still further, the segmented mold 106 is not limited to a constant cross-sectional size or shape. Alternatively, the segmented mold 106 may be tapered. A given segmented mold 106 used for the disclosed process can any one of have many different possible shapes, depending upon the articles desired. The segmented mold 106 can be shaped to create a specific part or parts, or any pre-formed shape which can be converted into a specific part or parts. In other aspects, the spaces between the segments of the segmented mold 106 can extend longitudinally along a primary axis of the segmented mold 106, horizontally in bands along the primary axis of the segmented mold 106, or in a repeating and or regular pattern around the exterior of the segmented mold 106.

The ingot 114 is kept molten and/or melted in part by a primary heating induction coil 124 that, through induction, keep at least part of the ingot 114 molten. In some aspects, the primary heating induction coil 124 is capable of heating the ingot 114 with eddy currents that pass through the configured gaps of the water-cooled, segmented mold 106. In various embodiments, the primary heating induction coil 124 can surround or be coupled to the entirety of the segmented mold 106, or a region of the segmented mold 106. The primary heating induction coil 124 is electrically coupled to and powered by a primary heating power supply 126 through primary electrical connections 128. The primary heating power supply 126 can be either an AC or a DC power supply, employing a power inverter or converter as necessary. A tuning capacitor 142 can be located in the circuit between the primary heating power supply 126 and the primary heating induction coil 124 and can be operable to tune the electrical load of the system.

A sense coil 130 can be positioned to surround at least a portion of the primary electrical connections 128 between the primary heating induction coil 124 and the tuning capacitor 142. The sense coil 130 only needs to be located around one of the primary electrical connection 128 leads between the primary heating power supply 126 and the primary heating induction coil 124. The sense coil 130 is an induction coil that can detect and measure fluctuations in the current of the primary heating induction coil 124 as carried by the primary electrical connections 128 as the load of the system changes. Specifically, electrical current flowing through the primary heating induction coil 124 and the tuning capacitor 142 induces a proportional current or frequency in the sense coil 130 circuit, which is indicative of the change in the load of the primary heating induction coil 124 circuit. The sense coil 130 is a separate structure than the primary heating induction coil 124, and does not have a role in powering or regulating the primary heating induction coil 124. In some embodiments, the sense coil 130 can be a single set of coils positioned around the primary electrical connections 128, while in other embodiments, the sense coil 130 can be a series or plurality of discrete coils position along the primary electrical connections 128. The sense coil 130 can further be arranged externally of the vacuum metallurgical chamber 102.

An electronic position controller 132 can be electronically coupled and in communication with the sense coil 130, the ingot position actuator 120, and a mold sensor 138. The sense coil 130 can provide a feedback signal 134 to the electronic position controller 132, where the feedback signal 134 is indicative of the current of the primary heating induction coil 124. The electronic position controller 132 can include a current meter in order to measure the fluctuations in current detected by the sense coil 130. The mold sensor 138 can be coupled to the segmented mold 106, and measure characteristics of the mold such as temperature. The mold sensor 138 can further be coupled to a video device configured to observe the top of the segmented mold 106 and monitor ingot 114 formation. Based on the signals and measurements received by the electronic position controller 132, the electronic position controller 132 can send a control signal 136 to the ingot position actuator 120, instructing the ingot position actuator 120 to raise, lower, and/or maintain the position of the ingot 114 within the segmented mold 106. In some aspect, the electronic position controller 132 can include an automatic closed loop electrical control device, configured to operate the ingot position actuator 120 with the electrical control signal 136, ultimately based upon the current fluctuations provided by the feedback signal 134 of the sense coil 130.

A control interface 140 can be coupled to and control various component of the system 100. The control interface 140 can include a microprocessor and processing device that controls operation of the instrumentation and can record measurements of the system. The control interface 140 can further include either or both of a user interface for a human operator to control and an automated control system. The control interface 140, electronically coupled directly or indirectly to any or all of the feed heating power supply 108, the primary heating power supply 126, the electronic position controller 132, and the ingot position actuator 120 can be used to instruct and control the position of the ingot 114 within the segmented mold 106, the amount of metal/alloy within the segmented mold 106, and the strength or intensity of energy produced by the primary heating induction coil 124. Moreover, the control interface 140 can be electronically coupled directly or indirectly to any or all of the material feed 104, secondary heating induction coil 110, and directed heating device 112, and operable to control the melting of metal/alloy material as well as the input of metal/ally into the segmented mold 106. The control interface 140 can also be used to characterize the system 100, establishing a baseline of current measurement, variation from which can be used to determine the location of the ingot within the mold walls 116.

In application, the tuned system 100 is set for optimized melting and ingot 114 casting conditions. As metal/alloy is added to the segmented mold 106, the load of the system changes, and the corresponding changes in the current of the primary heating induction coil 124, carried by the primary electrical connections 128, are measured by the sense coil 130. Generally, in situations where the measured region of the segmented mold 106 is completely full with metal/alloy, the primary heating induction coil 124 current reaches a lower-most value; therefore, when the measured current is lower, the position of the ingot 114 within the segmented mold 106 is higher. Conversely, in situations where the measured region of the segmented mold 106 is nearly empty, the primary heating induction coil 124 current reaches an upper-most value; therefore, when the measured current is higher, the position of the ingot 114 within the segmented mold 106 is lower. The lower-most and upper-most current measurements are dependent on the region of the segmented mold 106 that is heated and surrounded by the primary heating induction coil 124, as well as on the tuning and calibration of the furnace system 100.

In some embodiments, the segmented mold 106 can have a segmented temperature control system, allowing for the segmented mold 106 to be, for example, cooled at the bottom (e.g. by the water source 118) and heated at the top (e.g. by the primary heating induction coil 124), particularly where the molten material is fed into the mold. This maintains a certain depth of molten material above the portion of material that is in the process of solidifying at any given time. The pressure created by this molten head can help to ensure the formation of an ingot 114 which is free from porosity and other defects, such as solidification shrinkage voids. In addition, a constant mixing effect created by the primary heating induction coil 124 can help to ensure a chemically homogeneous molten pool, thereby ensuring a degree of chemical homogeneity throughout the length of the ingot 114. Some of the solidified material of the ingot 114 may also be re-melted by the molten head and mixed in with it, further adding to the homogeneity of the ingot 114.

Based on the measured current values, the furnace system 100 can be controlled or operated to take further actions, depending on the process stage of casting. For example, where the measured current is at or close to an upper-most value, indicating that the ingot 114 is toward the bottom of the segmented mold 106 or that the segmented mold 106 is empty, additional metal/alloy can be added to the ingot 114, forming a longer casting. Similarly, where the measured current is at or close to a lower-most value, indicating that the ingot 114 is filling most or all of the segmented mold 106, the addition of further metal/alloy can be paused, and the ingot position actuator 120 can be operated to move the withdrawal head 122 downward pulling the cast ingot 114 out of the open bottom of the segmented mold 106. Similarly, the power provided to the primary heating induction coil 124 can be adjusted based on the position of the ingot 114 within the segmented mold 106.

Accordingly, in any of a continuous, semi-continuous, batch, or iterative mode of production, the ingot position actuator 120 can draw a cast ingot 114 from the segmented mold 106 of desired length due to the ability to precisely add feed material at the top of the segmented mold 106 that will bind with the ingot 114 such that the ingot will have a homogeneous grain structure.

Figure 1C:
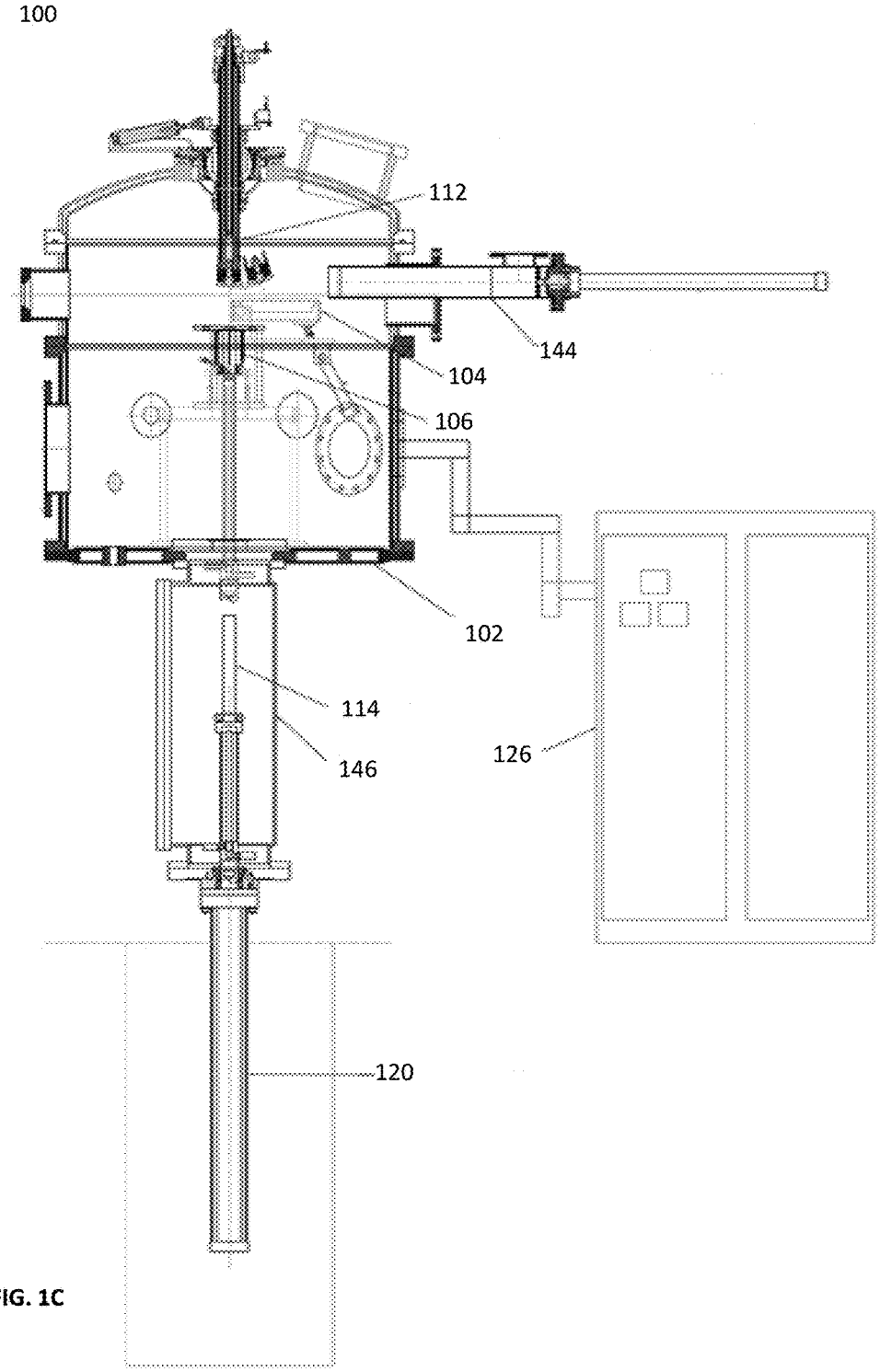
FIG. 1C is a schematic illustration of an embodiment of a vacuum metallurgical system for forming ingots as shown in FIG. 1B, according to aspects of the present disclosure.

FIG. 1C is a schematic illustration of an embodiment of a vacuum metallurgical system for forming ingots, presenting the furnace system 100 as a generalized illustration of the vacuum metallurgical chamber 102 with a directed heating device 112, as shown in FIG. 1B. Further illustrated is a material feed actuator 144, configured to provide the material feed 104 with the raw material to render into an ingot 114 within the segmented mold 106. Also further illustrated is a ingot withdrawal chamber 146, which can be coupled to the vacuum metallurgical chamber 102 through which the ingot position actuator 120 can withdraw the ingot 114 out of the vacuum metallurgical chamber 102, and from which the cast ingot 114 can be removed for further industrial use or post-processing. The primary heating power supply 126 is also illustrated, where the primary electrical connections 128 and the sense coil 130 can be contained within a housing of the primary heating power supply 126 or within a housing connecting to the vacuum metallurgical chamber 102.

Figure 2:
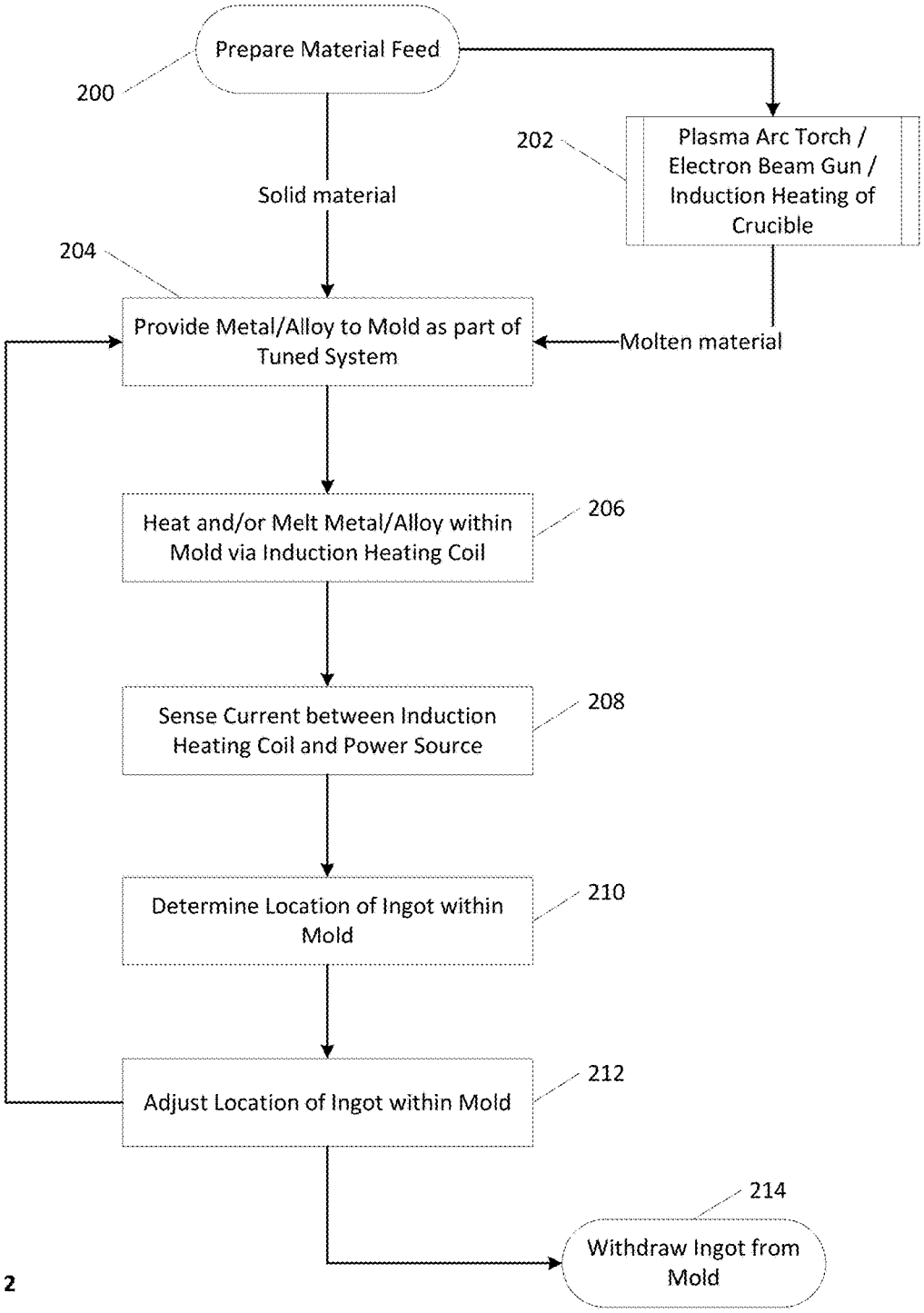
FIG. 2 is a flowchart representing a process for forming ingots using an inductive sensory system, according to aspects of the present disclosure.

FIG. 2 is a flowchart representing a process for forming ingots using an inductive sensory system. At step 200, a material feed is prepared, where the material feed includes reactive or refractory metals alloys, or a combination thereof. The raw material for the material feed is prepared in discrete amounts such that its composition is within the allowable limits for the mixture or alloy desired. Common forms of raw material include compacted disks; cylinders; blocks; loose material wrapped in foil to form a ball; unwrapped loose material; and scrap pieces of the desired metal, mixture of metals, or alloy. The raw material may, however, be in any suitable form. The raw material then enters a crucible/vessel by any appropriate method, such as, for example, by being pushed in by a bar feeder, dropped in by a bulk feeder, or, in the case of loose material, fed through a hopper or spoon-type canister and then dropped into the crucible/vessel.

At step 202, the metal/alloy of the material feed is melted into a molten state, by a heating means that can include, but is not limited to a plasma arc torch, an electron beam gun, or an induction heater that heats the material feed held within the material feed crucible. For situations in which an alloy ingot is desired, correct melting and mixing of the raw material is crucial. The volume of the crucible/vessel holding the material feed should thus be large enough to hold the discrete pieces of raw material while melting, as well as to effectively pre-mix the alloy and even out any small compositional variations inherent to the raw material from one piece to the next. This may be further achieved by purposely emptying the crucible/vessel on a regular basis, leaving a minimal amount of skull to avoid the build-up of higher melting point elements, components, or alloys. The crucible/vessel is not purposefully used to refine the alloy, so relatively long residence times are not required. The tilt-pouring of a crucible/vessel can enable the rapid turnover of raw material, thereby creating a nearly homogeneous liquid, which is then delivered to a mold.

At step 204, the metal/alloy of the material feed is provided to a mold as part of a tuned system, where the metal/alloy can be received either in a solid state (from step 200) or in a molten state (from step 202). In embodiments where the material feed is melted before being provided to the mold, once a sufficient amount of metal/alloy has melted and collected at the top of the vessel, the vessel is tilted by any appropriate actuators to pour a desired amount of the molten material into the mold. The material can be poured in discrete amounts or batches. In alternative embodiments of the process, metal/alloy received in a molten state can retain remnants of solid feed material. At step 206, the metal/alloy can be heated within the mold via an induction heating coil surrounding or proximate to the mold. The induction heating coil can be powered so as to maintain the metal/alloy as molten, as well as to melt any solid pieces of the material feed within the mold. The molten metal/alloy can thereby form or join to an ingot within the mold. At step 208, the current between the induction heating coil and the power supply powering the induction heating coil can be measured for variations that indicate a change in the load of the circuit formed by the induction heating coil and its power supply. Generally, at least one sensor induction coil is positioned to measure the current between induction heating coil and its power supply, and is configured to convert either or both of current amplitude and current frequency detected in that electrical into an electrical control signal that is provided to a controller system. At step 210, the position of the ingot within the mold, particularly the vertical location of the ingot, can be determined based on the variations in the current between the induction heating coil and its power supply.

At step 212, the location of the ingot within the mold can be adjusted, for example by a physical actuator, to raise, lower, or otherwise position the ingot within the mold. The ingot can be moved within the mold in order to, for example, allow for additional metal/alloy to be added to the mold, to receive additional metal/alloy proximate to the induction heating coil such that the added metal/alloy will bind with the ingot in a desired manner. In other words, the top of the ingot is positioned, either automatically based on feedback signals from a sensory coil or manually through an operation interaction, proximate to the primary heating induction coil to as to remain or rendered molten. Alternatively, the ingot can be moved to withdraw the ingot from the mold. In other words, after an amount of metal/alloy is poured into the mold, the ingot is moved downward to provide more open space at the top of the mold for the next amount of material to be fed therein. Thus, the ingot is either continuously or incrementally lowered within the mold, by pulling the solidified portion of the ingot out of the bottom of the mold with any suitable mechanism, such as a hydraulic cylinder, a movable clamp, puller head, or drive rolls. The ingot can also be raised within the mold as needed to continue formation or extension of the ingot. From step 212, the process can return to step 204 to add further metal/alloy to the mold, thereby increasing the length of the ingot. Alternatively, from step 212, the process can proceed to step 214 where the ingot is withdrawn from the mold.

It can be appreciated that an ingot cast according to the disclosed method can have a small cross-sectional area of about 7.1 square inches or less. Further, an exemplary ingot size can be about 2⅛ inches in diameter and 120 inches or more in length. The ingots produced by the disclosed methods may be very close to a desired final size and shape, and require only a minimal amount of machining to remove undesirable as-cast features related to the way the ingot solidifies and cools. In other words, this process can provide for small-diameter ingots that need minimal, if any, surface machining of the outside diameter in order to produce a bar with a desirable surface finish. Moreover, ingot cast according to the disclosed method can be produced more consistently and repeatably with the desired surface finish, improving both the product as well as the efficiency of the method and system. Furthermore, the surface area to volume ratio and associated cooling of an ingot having a small cross-sectional area, as well as the temperature gradients established within the ingot, can lead to an ingot having a desired grain size as-cast suitable for post-processing applications. Thus, some ingots produced by this process can be forged in the as-cast condition. In some examples, a titanium alloy ingot can have an as-cast grain size of about one hundred micrometers (100 mm) or less.

Figures 3A, 3B, 3C, 3D, 3E, 3F, 3G:
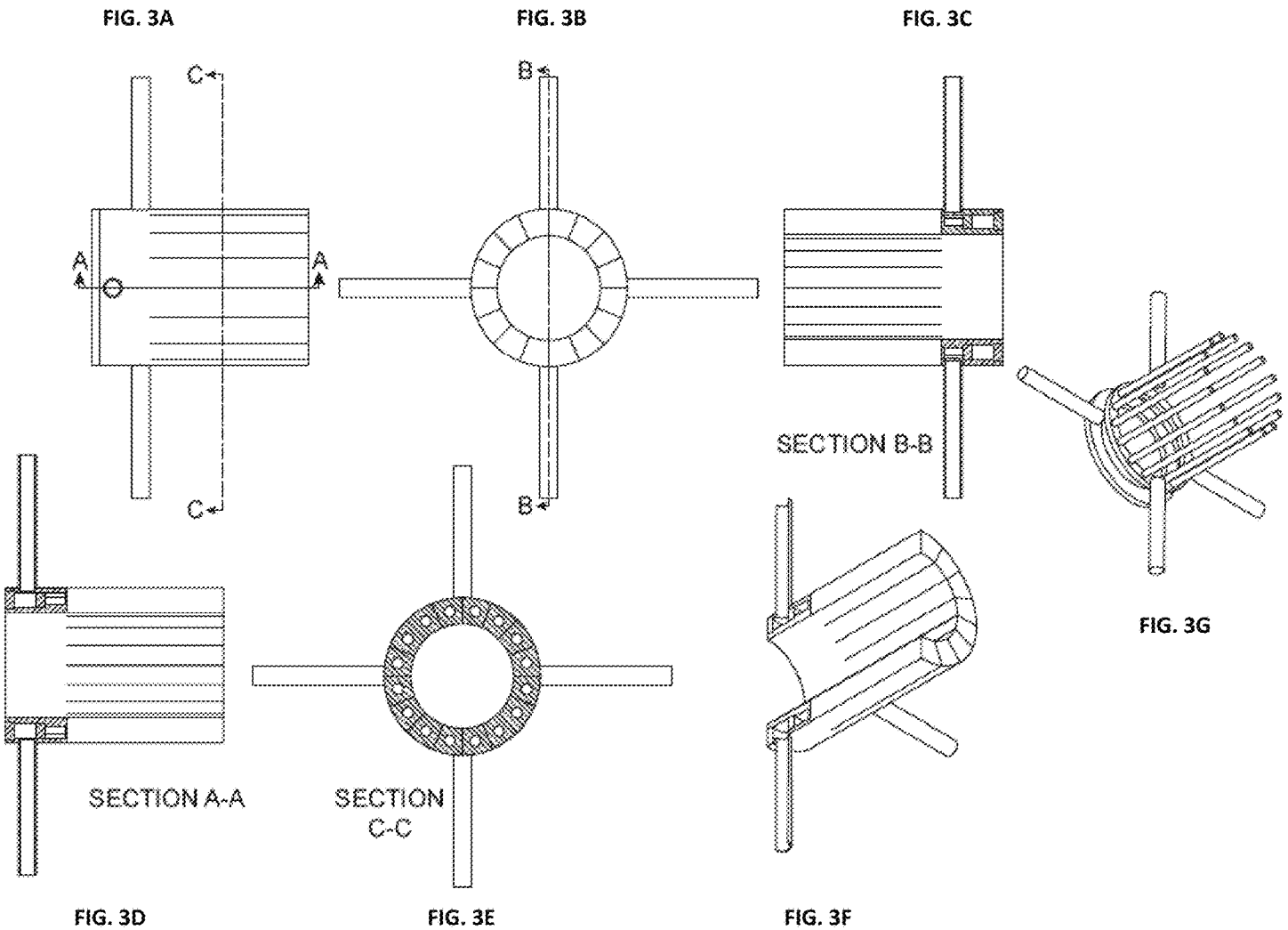
FIGS. 3A-3G are various views of a segmented mold for a vacuum metallurgical system, according to aspects of the present disclosure.

FIGS. 3A-3G are various views of a segmented, water-cooled mold for a furnace system. Specifically: FIG. 3A shows a side view of the segmented mold; FIG. 3B shows a top view of the segmented mold; FIG. 3C shows a side cross-sectional view of the segmented mold along the line B as indicated in FIG. 3B; FIG. 3D shows a side cross-sectional view of the segmented mold along the line A as indicated in FIG. 3A; FIG. 3E shows a top cross-sectional view of the segmented mold along the line C as indicated in FIG. 3A, further showing spaces in the mold receptive to a water-cooling structure; FIG. 3F shows a cross-sectional perspective view of the segmented mold; and FIG. 3G shows a perspective view of a water-cooling structure that can couple with the mold.

Exemplary Ingot Position Calibration Data

Tables 1A-1D below document exemplary data collected to determine the relationship between the top of the ingot melting versus position of the ingot within the mold. Stubs of previously melted ingots were cut and placed in the mold at specified distances from the top of the mold. Induction power was gradually increased and the tank circuit current measured using a Rogowski Belt and associated digital readings. The induction power supply was set in a "Constant Power" mode of operation, shown as a percentage of maximum (100%) power output. After the tests were completed, the chamber was opened, the ingot removed, and a visual inspection of the ingot was made.

The system used for testing included a Pillar Mark 5 power supply operated at 150 kW, a PAM-5 signal modulator, and a mold having a fifty-three millimeter (53 mm) internal diameter in which the ingot was cast. Table 1A provides test results from a metal stub of 5⅛ inches in length, positioned 7⅝ inches from the top of the mold. Table 1B provides test results from a metal stub of 3⅝ inches in length, positioned 8½ inches from the top of the mold. Table 1C provides test results from a metal stub of 7 inches in length, positioned 5¼ inches from the top of the mold. Table 1D provides test results from a metal stub of 6 inches in length, positioned 6 inches from the top of the mold, with an additional charge of metal melted and added to cast as part of the ingot within the mold. The metal stubs used for the testing were composed of a titanium-niobium-molybdenum ("TNM") alloy. The induction coil heating the material within the mold was positioned proximate to the open-top of the mold.

TABLE 1A

Stub Length: 5⅛"
Set in Mold: 7⅛" from top

| Time (min.) | Power Dial Setting (%) | Tank Amps |
|---|---|---|
| 0 | 0 | 603 |
| 5 | 19% | 631 |
| 7 | 30% | 926 |
| 9 | 40% | 1,090 |
| 11 | 50% | 1,225 |
| 13 | 60% | 1,349 |
| 15 | 70% | 1,429 |
| 17 | 85% | 1,613 |
| 23 | 85% | 1,613 |
| 27 | Power down 10% per min | Not measured |

Post Test Inspection: Small molten pool at top of ingot.

TABLE 1B

Stub Length: 3⅞"
Set in Mold: 8½" from top

| Time (min.) | Power Dial Setting (%) | Tank Amps |
|---|---|---|
| 0 | 0 | 667 |
| 5 | 20 | 706 |
| 7 | 30 | 964 |
| 9 | 40 | 1,136 |
| 11 | 50 | 1,273 |
| 13 | 60 | 1,394 |
| 15 | 70 | 1,480 |
| 17 | 85 | 1,654 |
| 20 | 85 | 1,654 |
| 27 | 85 | 1,654 |
| 27 | Power down 10% per min. | Not measured |

Post Test Inspection: Top of ingot barely molten.

TABLE 1C

| Stub Length: 7" Set in Mold: 5¼" from top | | |
|---|---|---|
| Time (min.) | Power Dial Setting (%) | Tank Amps |
| 0 | 0 | 558 |
| 3 | 0 | 563 |
| 5 | 20 | 627 |
| 7 | 30 | 880 |
| 9 | 40 | 1,034 |
| 11 | 50 | 1,150 |
| 13 | 60 | 1,263 |
| 15 | 70 | 1,341 |
| 17 | 85 | 1,505 |
| 27 | 85 | 1,513 |
| 27 | Power Down 10% per min. | Not Measured |

Post Test Inspection: Top of ingot fully molten.

TABLE 1D

| Stub Length: 6" Set in Mold: 6" from top | | |
|---|---|---|
| Time (min.) | Power Dial Setting (%) | Tank Amps |
| 0 | 0 | 610 |
| 5 | 20 | 677 |
| 7 | 30 | 909 |
| 9 | 40 | 1,068 |
| 11 | 50 | 1,194 |
| 13 | 60 | 1,314 |
| 15 | 70 | 1,392 |
| 17 | 85 | 1,545 |
| 17.5 | Plasma Arc Torch Started | |
| 19 | Melting in hearth | |
| 22.5 | Hearth charge all melted | |
| 27 | 85 started casting ingot | 1400 |
| 27.5 | 85 | 1520 |
| Not noted, other pours | 85 | 1420 full to 1520 low |
| 34 | 85 Plasma arc torch off | Not measured |
| 34.5 | 85 Auto withdrawal of ingot | Not measured |

Post Test Inspection: Cast approximately 600 mm long ingot; ingot surface finish acceptable Generally, the testing indicated that when the mold was empty, the circuit current between the induction heating coil and its power supply (alternatively referred to as the "tank circuit current") could reach a maximum value of about 1,650 Amp. When the top of the ingot was higher in the mold, the tank circuit current was at a baseline value of about 1,510 Amp. When an ingot was cast (as reflected in Table 1D), by sequentially pouring from the hearth and withdrawing the ingot accordingly, even lower tank circuit current readings were observed, with a lowest recorded reading of 1,420 Amp.

As seen in Table 1A, positioning a stub 7⅛ inches from the top of the mold resulted in a small molten pool at top of ingot, indicating that the stub was positioned low within the mold relative to the induction heating coil. The small molten pool at the top of the ingot would not necessarily be sufficient or ideal for adding to the cast ingot. As seen in Table 1B, positioning a stub 8½ inches from the top of the mold resulted in a the top of the ingot being barely molten, reinforcing the indication that the stub was positioned too low within the mold relative to the induction heating coil. As seen in Table 1C, positioning a stub 5¼ inches from the top of the mold resulted in a the top of the ingot being fully molten, and thus prime for the addition of further metal/alloy for casting an ingot.

For the tests shown in Table 1D, additional actions were taken during periods where the power of the system was set to 85%. Specifically: at time 17.5 min., the plasma arc torch was started; at time 19 min., melting was conducted with the plasma arc torch on a metal charge within the hearth; at time 22.5 min., the charge within the hearth was determined to be completely melted and subsequently added to the mold to cast an ingot. Testing as shown in Table 1D, positioning a stub 6 inches from the top of the mold, and pouring additional molten material into the mold, resulted in a cast ingot have a length of approximately 600 mm, where the ingot had a surface finish acceptable as-cast for post-processing applications.

Subsequent ingot casting tests revealed tank circuit current readings (with the induction power supply setting at 85%) of about 1,350 Amp if the molten pool was near the top of the mold. However, the molten pool began to solidify due to a lack of adequate power input. In other words, if the ingot was positioned too high within the mold, the load of the circuit was not optimized and thereby moved the power supply out of its optimum melting range.

It is appreciated that the exemplary data provided herein is not limiting to only the disclosed structural details. Rather, rendering the top of an ingot to be fully molten while within a mold, such that additional metal/alloy will homogeneously bind with the ingot, can be accomplished using ingot lengths, metals and alloys, power settings, duration of heating, and configurations of melting system components consistent with the present disclosure.

It is further appreciated that the measured fluctuations in current may vary based on the composition of the metal/alloy being melted. For example, while the exemplary embodiment disclosed herein used a TNM alloy and measured the corresponding changes in current, an ingot or charge composed of different metals or alloys, such as copper or titanium-aluminum, can have different current characteristics. Accordingly, the calibration and operation of a melting system can vary based on the intermetallic identity of the ingot formed in the system.

It can be further appreciated that the system and method disclosed herein is applicable to standard-sized ingots as well as reduced-sized ingots, or any width/diameter of ingot, as produced in industry, allowing for the monitoring and related manipulation of an ingot being cast within a mold, and heated with an induction coil while within the mold. This system and method can be used to produce ingots of any length (as constrained by the physical size of the system). The breadth of the present system and method can be applied across the industry, as accurate control of the ingot position within the mold, for any size of ingot, can assist in optimizing as-cast ingot grain structure and/or surface finish.

The system, and particularly the control interface, can include a microprocessor that can further be a component of a processing device that controls operation of the furnace instrumentation and can record measurements of the system. The processing device can be communicatively coupled to a non-volatile memory device via a bus. The non-volatile memory device may include any type of memory device that retains stored information when powered off. Non-limiting examples of the memory device include electrically erasable programmable read-only memory ("ROM"), flash memory, or any other type of non-volatile memory. In some aspects, at least some of the memory device can include a non-transitory medium or memory device from which the processing device can read instructions. A non-transitory computer-readable medium can include electronic, optical, magnetic, or other storage devices capable of providing the processing device with computer-readable instructions or other program code. Non-limiting examples of a non-transitory computer-readable medium include (but are not limited to) magnetic disk(s), memory chip(s), ROM, random-access memory ("RAM"), an ASIC, a configured processor, optical storage, and/or any other medium from which a computer processor can read instructions. The instructions may include processor-specific instructions generated by a compiler and/or an interpreter from code written in any suitable computer-programming language, including, for example, C, C++, C#, Java, Python, Perl, JavaScript, etc.

The above description is illustrative and is not restrictive, and as it will become apparent to those skilled in the art upon review of the disclosure, that the present invention may be embodied in other specific forms without departing from the essential characteristics thereof. For example, any of the aspects described above may be combined into one or several different configurations, each having a subset of aspects. Further, throughout the foregoing description, for the purposes of explanation, numerous specific details were set forth in order to provide a thorough understanding of the invention. It will be apparent, however, to persons skilled in the art that these embodiments may be practiced without some of these specific details. These other embodiments are intended to be included within the spirit and scope of the present invention. Accordingly, the scope of the invention should, therefore, be determined not solely with reference to the above description, but instead should be determined with reference to the following and pending claims along with their full scope of legal equivalents.

What is claimed is:

1. A method to determine the position of an ingot within a vacuum metallurgical system mold, comprising:

providing a metal and/or alloy into a segmented mold, the segmented mold being an open-top and open-bottom mold;

heating the metal and/or alloy within the segmented mold with a heating induction coil, wherein the heating induction coil and a high frequency power supply are electrically connected to a tuning capacitor;

maintaining the molten metal and/or alloy in a molten state and melting any solid portion of the metal and/or alloy within the segmented mold to a molten state;

forming an ingot within the segmented mold with the molten metal and/or alloy;

determining the position of the ingot within the segmented mold with a sense coil; and tuning an electrical circuit comprised of the heating induction coil, the mold and its contents, and the power supply to optimize a power level for melting within the mold.

2. The method of claim 1, wherein the sense coil is configured to detect electrical current in a conductor between the heating induction coil and the tuning capacitor, such that the electrical current flowing through the induction melting coil and the tuning capacitor induces a proportional current or frequency in the sense coil circuit.

3. The method of claim 1, wherein sense coil is connected in series with an electronic position controller configured to measure changes in electrical current detected by the sense coil.

4. The method of claim 3, further comprising:

the electronic position controller converting the current detected in the sense coil into an electrical control signal;

instructing an ingot position actuator to move the ingot within the segmented mold proximate to the heating induction coil; and maintaining the top of the ingot in a molten state.

5. The method of claim 4, wherein the electronic position controller instructs the ingot position actuator via operator interaction.

6. The method of claim 4, wherein the electronic position controller instructs the ingot position actuator via an automatic feedback loop.

7. The method of claim 3, further comprising:

the electronic position controller converting the current detected in the sense coil into an electrical control signal; and adjusting power supplied to the heating induction coil to change the degree of heating the metal and/or alloy within the segmented mold.

8. The method of claim 1, further comprising adjusting a pour rate of molten metal and/or alloy into the segmented mold based on the determined position of the ingot within the segmented mold.

9. The method of claim 1, further comprising withdrawing the ingot from the segmented mold, the ingot having a reduced cross-sectional area.

10. A method to determine the position of an ingot within a vacuum metallurgical system mold, comprising:

providing a metal and/or alloy into a segmented mold, the segmented mold being an open-top and open-bottom mold;

heating the metal and/or alloy within the segmented mold with an heating induction coil;

maintaining the molten metal and/or alloy in a molten state and melting any solid portion of the metal and/or alloy within the segmented mold to a molten state;

forming an ingot within the segmented mold with the molten metal and/or alloy; and determining the position of the ingot within the segmented mold with a sense coil, wherein the sense coil is connected in series with an electronic position controller configured to measure changes in electrical current detected by the sense coil.

11. The method of claim 10, wherein the heating induction coil and a high frequency power supply are electrically connected to a tuning capacitor, further comprising:

tuning an electrical circuit comprised of the heating induction coil, the mold and its contents, and the power supply to optimize a power level for melting within the mold.

12. The method of claim 11, wherein the sense coil is configured to detect electrical current in a conductor between the heating induction coil and the tuning capacitor, such that the electrical current flowing through the induction melting coil and the tuning capacitor induces a proportional current or frequency in the sense coil circuit.

13. The method of claim 10, further comprising:

the electronic position controller converting the current detected in the sense coil into an electrical control signal;

instructing an ingot position actuator to move the ingot within the segmented mold proximate to the heating induction coil; and maintaining the top of the ingot in a molten state.

14. The method of claim 13, wherein the electronic position controller instructs the ingot position actuator via operator interaction.

15. The method of claim 13, wherein the electronic position controller instructs the ingot position actuator via an automatic feedback loop.

16. The method of claim 10, further comprising:

the electronic position controller converting the current detected in the sense coil into an electrical control signal; and adjusting power supplied to the heating induction coil to change the degree of heating the metal and/or alloy within the segmented mold.

17. The method of claim 10, further comprising adjusting a pour rate of molten metal and/or alloy into the segmented mold based on the determined position of the ingot within the segmented mold.

18. The method of claim 10, further comprising withdrawing the ingot from the segmented mold, the ingot having a reduced cross-sectional area.

* * * * *